US006641321B2

(12) United States Patent
Horng

(10) Patent No.: US 6,641,321 B2
(45) Date of Patent: Nov. 4, 2003

(54) TOOTH CLEANING ASSEMBLY

(76) Inventor: Bae-Yan Horng, No. 3-1, Alley 4, Lane 81, Kuang Chou St., Taipei (TW)

( * ) Notice: Subject to any disclaimer, the term of this patent is extended or adjusted under 35 U.S.C. 154(b) by 0 days.

(21) Appl. No.: 09/773,507

(22) Filed: Feb. 2, 2001

(65) Prior Publication Data

US 2001/0004428 A1 Jun. 21, 2001

Related U.S. Application Data

(63) Continuation-in-part of application No. 09/391,076, filed on Sep. 4, 1999.

(51) Int. Cl.[7] ..... A46B 11/04

(52) U.S. Cl. ..... 401/272; 401/188 R; 401/119; 401/123; 401/195; 206/362

(58) Field of Search ..... 401/176, 171, 401/131, 270, 187, 188 R, 119, 123, 195; 206/362, 362.1, 362.2, 362.3

(56) References Cited

U.S. PATENT DOCUMENTS 3,002,798 A * 10/1961 Corely ..... 401/125
3,143,152 A * 8/1964 Knable ..... 401/125
3,734,118 A * 5/1973 Howard ..... 401/125
4,228,925 A * 10/1980 Mandelovich ..... 401/125
5,860,522 A * 1/1999 Lee ..... 401/125

* cited by examiner

*Primary Examiner*—David J. Walczak
(74) *Attorney, Agent, or Firm*—Rosenberg, Klein & Lee

(57) ABSTRACT

A tooth cleaning assembly including a rack, and at least one detachable toothpaste squeezing assembly mounted on the rack. The assembly further includes a base, a toothpaste cylinder having a lower end fitted in the base, an annular member arranged at an upper end of the toothpaste cylinder, a cover fitted on a top of the toothpaste cylinder and mounted on the annular member, a tubular neck telescopically fitted in the toothpaste cylinder, a cap pivotally connected with an upper end of the tubular neck, and a movable knob extending through the rack to be detachably engaged with a bottom of the base. At least one toothbrush is detachably mounted on the annular member, and at least one spring mug is fitted within the rack, so that all commonly used tooth brushing articles are combined into one unit thereby making them convenient to use and arranging them in a tidy manner.

4 Claims, 15 Drawing Sheets

TOOTH CLEANING ASSEMBLY

CROSS-REFERENCE

This is a continuation-in-part of U.S. patent application Ser. No. 09/391,076, filed Sep. 4, 1999.

BACKGROUND OF THE INVENTION (a) Technical Field of the Invention

This invention is related to an improved tooth cleaning assembly.

(b) Description of the Prior Art

Generally, a person keeps a toothbrush, toothpaste, and a mug separately on a vanity cabinet in the bathroom When the person wants to brush his teeth, it is necessary to hold the toothpaste with one hand, open the cap of the toothpaste with another hand, set down the cap, pick up the toothbrush, squeeze the toothpaste on to the toothbrush, and then put the toothpaste back in the vanity cabinet, creating an inconvenient operation. Hence, various kinds of toothpaste squeezers have been developed to streamline this process, but it is still necessary to align the toothpaste with the toothbrush and squeeze the toothpaste onto the toothbrush, thus making the squeezers unsatisfactory for practical use.

Therefore, it is an object of the present invention to provide a tooth cleaning assembly which can obviate and mitigate the above-mentioned drawbacks.

SUMMARY OF THE INVENTION

This invention is related to a tooth cleaning assembly.

It is the primary object of the present invention to provide a tooth cleaning assembly which combines all commonly used tooth cleaning articles into one unit thereby making them convenient to use and arranging them in a tidy manner.

It is another object of the present invention to provide a tooth cleaning assembly which enables one to choose the desired toothbrush and toothpaste easily by the rotation of the annular member and the toothpaste squeezing assembly.

It is still another object of the present invention to provide a tooth cleaning assembly which will automatically apply toothpaste to a desired toothbrush.

It is still another object of the present invention to provide a tooth cleaning assembly which is compact.

It is a further object of the present invention to provide a tooth cleaning assembly in which the toothbrush and toothpaste can be foldably connected, thus making them easy to carry and suitable for practical use.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
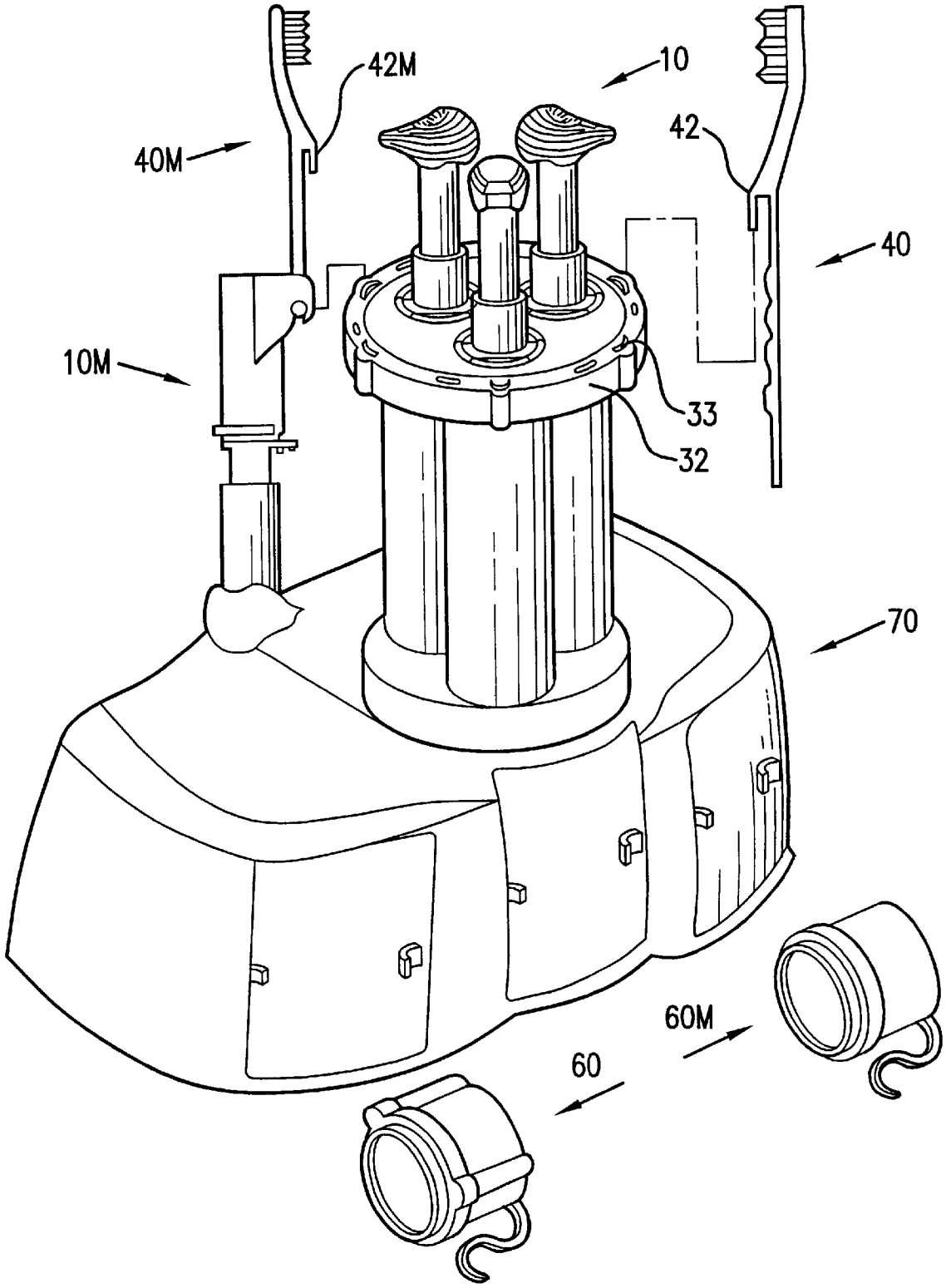
FIG. 1 is a partially exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, alterations and further modifications in the illustrated device, and further applications of the principles of the invention as illustrated herein being contemplated as would normally occur to one skilled in the art to which the invention relates.

Figure 2:
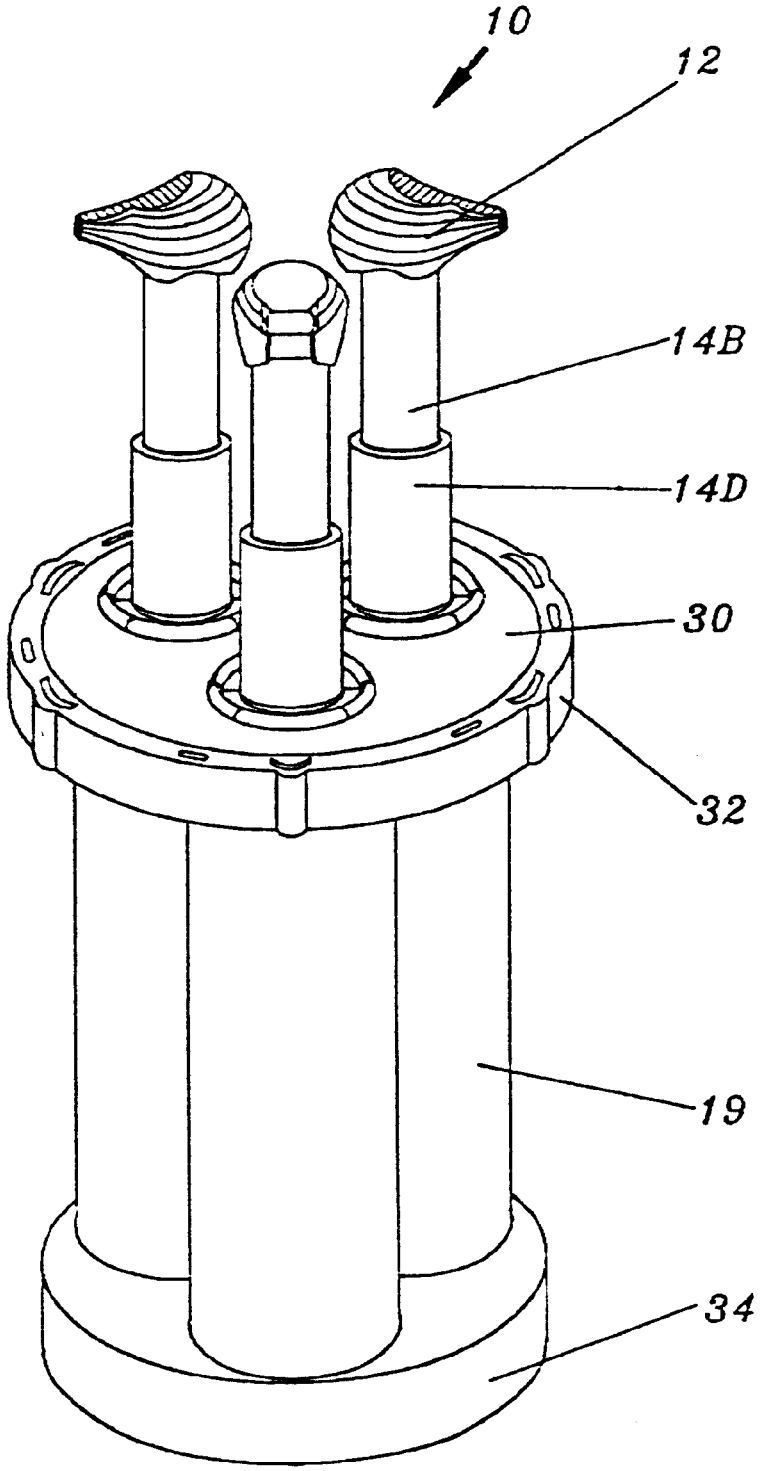
FIG. 2 is a perspective view of the present invention.
Figure 3:
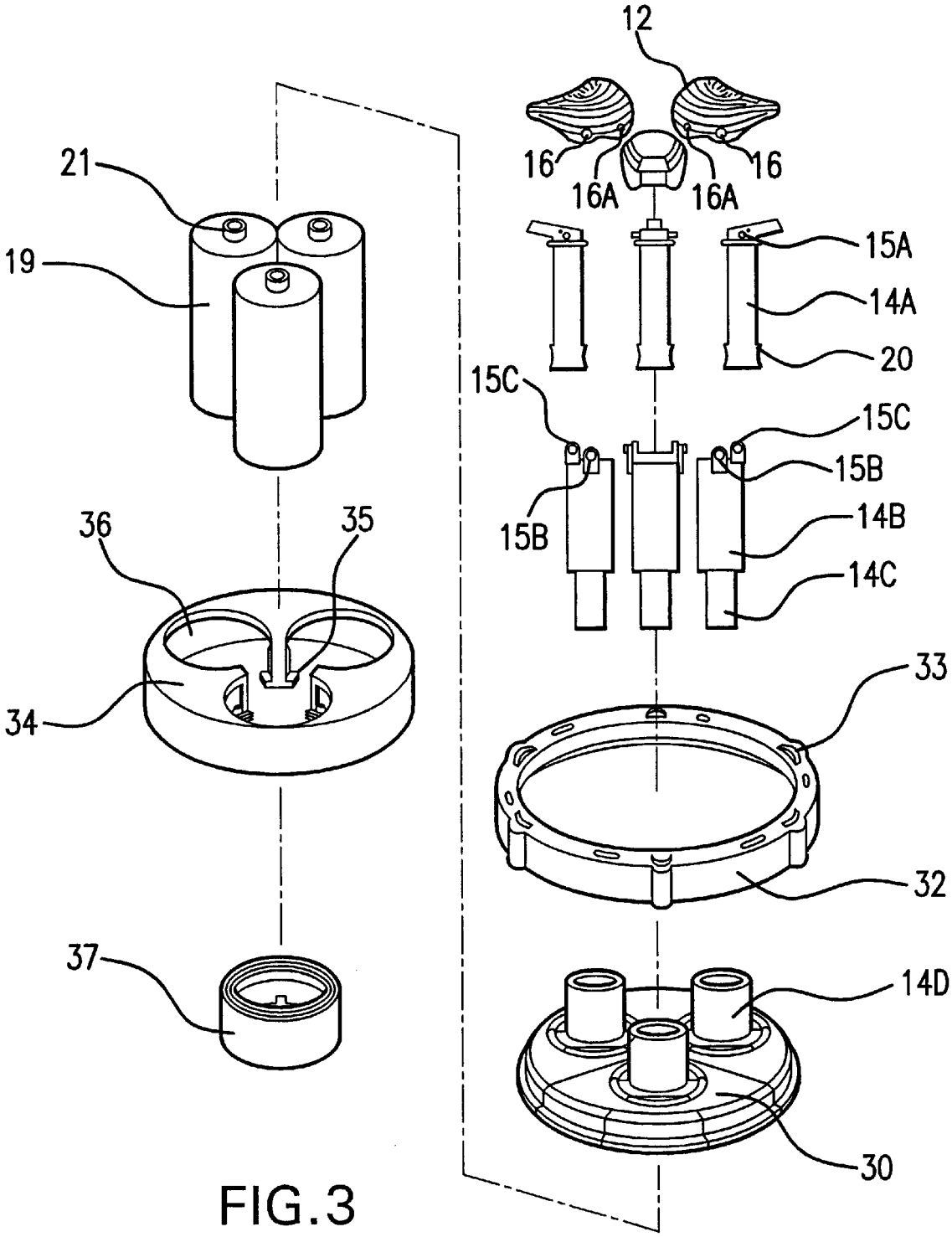
FIG. 3 is an exploded view of the toothpaste squeezing device.
Figure 4:
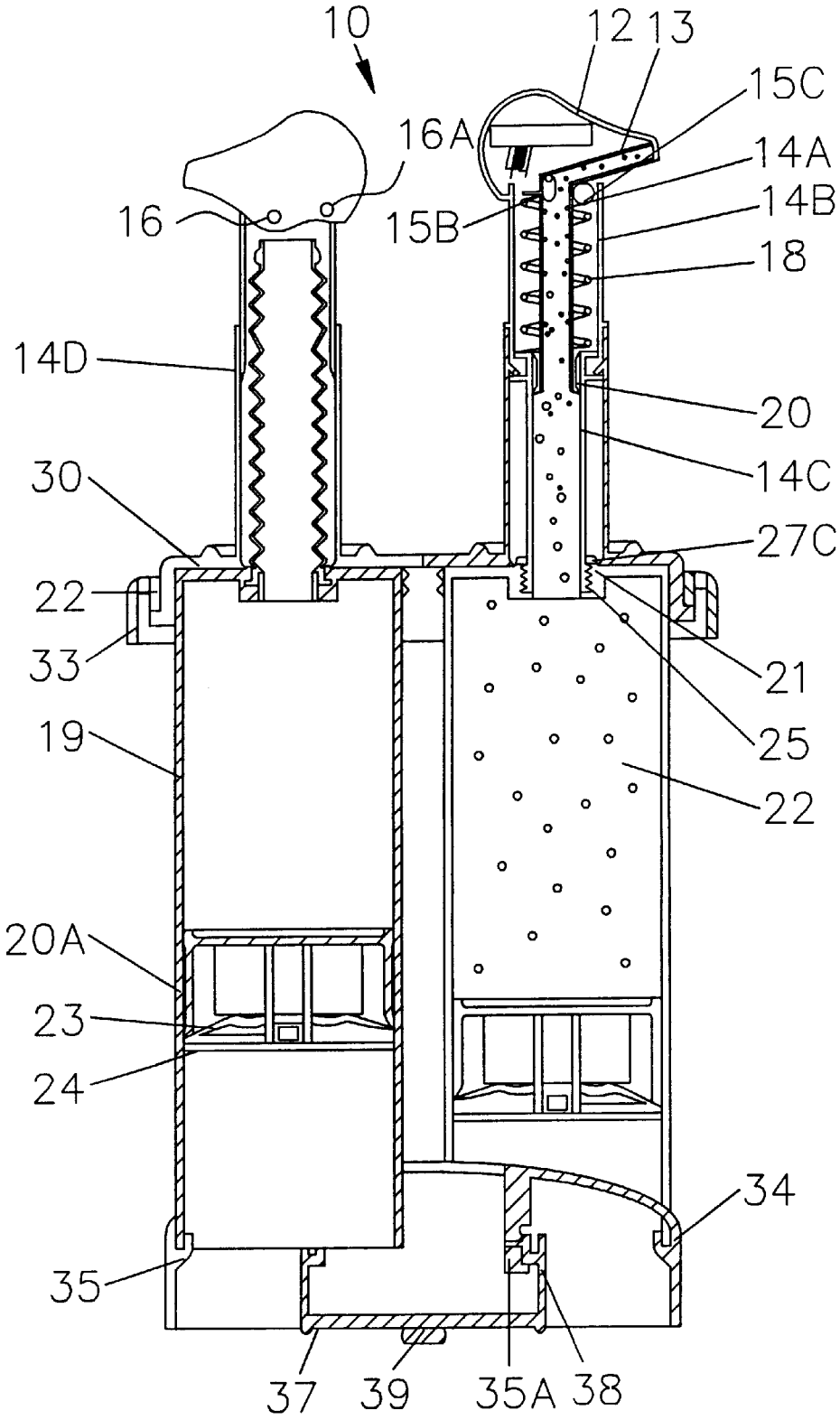
FIG. 4 is a sectional view of the toothpaste squeezing device.

With reference to the drawings and in particular to FIG. 1 thereof, the tooth cleaning assembly according to the present invention generally comprises toothpaste squeezing assemblies 10 and 10M, toothbrushes 40 and 40M, spring mugs 60 and 60M, and a rack 70. Referring to FIGS. 2, 3 and 4, the toothpaste squeezing assembly 10 includes caps 12, tubular necks 14A, 14B, 14C and 14D, toothpaste cylinders 19, an annular member 32 with lugs 33, a cover 30, a base 34 and a movable cap 37. The caps 12, tubular necks 14A, 14B, 14C and 14D and toothpaste cylinders 19 are joined together to form the toothpaste squeezer. The movable cap 37 is engaged with the base 34. The toothpaste cylinder 19 is fitted in the hole 36 of the base 34 and held in place by the hooks 35. The upper end of the toothpaste cylinder 19 is engaged with the cover 30 which is in turn held in place by the annular member 32. The outlet 21 at the top of the toothpaste cylinder 19 is connected with the lower end of the tubular neck 14C.

As shown in FIGS. 3 and 4, the toothpaste squeezer includes a cap 12, having a bottom connected with the outer upper tubular neck 14B. The cap 12 has two sets of through holes 16 and 16A. The holes 16 are connected to outer tubular neck 14B by pins 15C and through holes 16A are also connected to inner tubular neck 14A by pins 15A. The inner upper tubular neck 14A is slidably fitted within the outer upper tubular neck 14B and provided with a projection 20 at the lower end. A spring 18 is fitted between the inner and outer tubular necks 14A and 14B. The lower end of the outer upper tubular neck 14B is slidably fitted in the outer lower tubular neck 14D which is formed integrally with the cover 30. The inner lower tubular neck 14C is fitted within the outer lower tubular neck 14D and engaged with the outlet 21 of the toothpaste cylinder 19 through threads 25 or conical circular portions (not shown).

The annular member 32 is mounted on the outer edge of the cover 30. A piston 20A is fitted inside the lower end of the toothpaste cylinder 19 thereby forming a chamber for receiving toothpaste 22. The piston 20A is provided with a non-return member 23 and a bottom cover 24. The toothpaste squeezer 10 is fitted in the hole 36 of the base 34, with the hooks 35 supporting the toothpaste cylinder 19. The movable cap 37 has an engaging member engaged with the engaging member 35A of the base 34.

When in use, it is only necessary to press the front portion of the cap 12 so that the pins 15A of the inner upper tubular neck 14A act as a main axle in the axle slots 15B of the outer upper tubular neck 14B. The inner upper tubular neck 14A is lowered, the pins 15A being displaced within the slots 15B to pivotally open the cap 12 to expose the outlet 13 by pressing on the cap 12. As pressure is maintained on the cap 12, the piston 20A is blocked by the non-return member 23, thereby squeezing toothpaste 22 out of the outlet 13 as the tubular necks 14A and 14B move downwardly, and apply it to the head of the toothbrush. The toothbrush 40 and/or 40M is then removed for use.

Subsequent to removal of pressure from cap 12, the spring 18 forces the tubular necks 14A and 14B and the cap 12 to return to their original positions. The cap 12 is moved by the upward force of the axle define by pins 15A to close the outlet 13. Since the tubular necks are smaller than the toothpaste cylinder 19, the toothpaste will adhere to the tubular necks more than to the toothpaste cylinder 19 so that the piston 20A and the non-return member 23 will move upwardly to be in position for future use. The upper end of the outlet 21 and the lower end of the outer upper tubular neck 14B are respectively formed with engaging threads 27A and 25, so that the toothpaste cylinder 19 can be replaced.

In addition, the cap 12 may be provided with a sound card, an air whistle (not shown) or a music integrated circuit so that when the cap 12 is opened, sounds will be generated. The hook 35 must be made as an independent component so as to enable the user to replace the toothpaste cylinder 19 from the bottom.

Figure 5A:
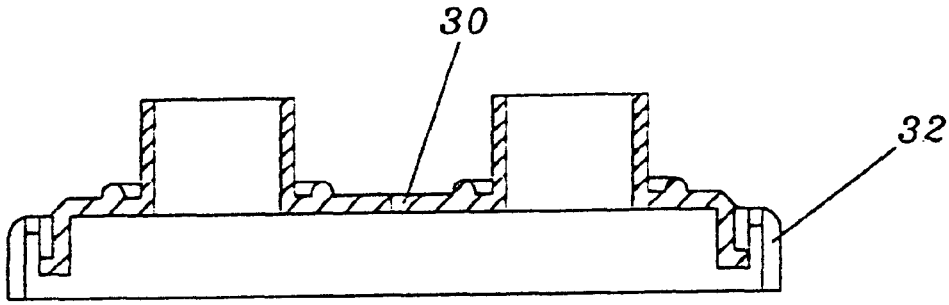
FIG. 5A is a sectional view illustrating the engagement between the annular member and the cover.
Figure 5B:
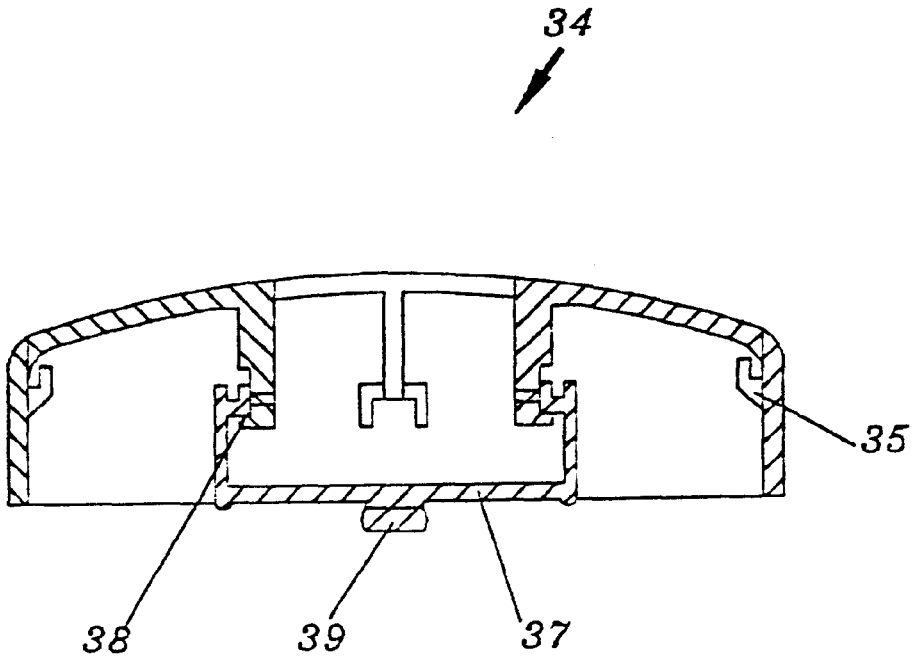
FIG. 5B is a sectional view illustrating the engagement between the base and the detachable knob.
Figure 6A:
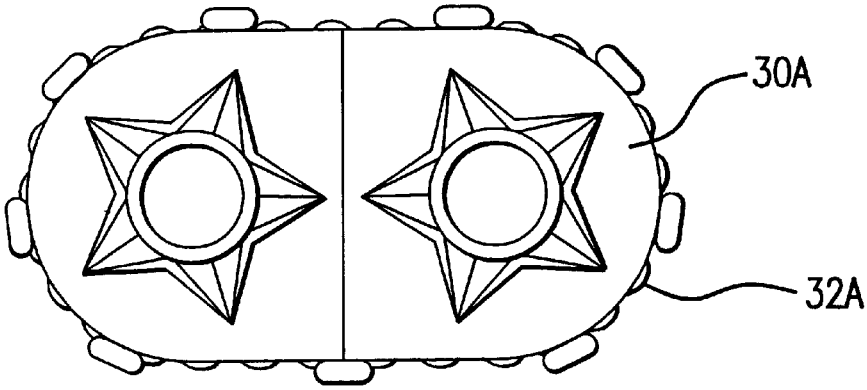
FIGS. 6A–6B show a second preferred embodiment of the annular member and the cover.
Figure 6B:
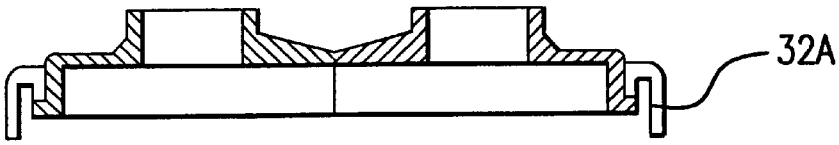
Figure 6C:
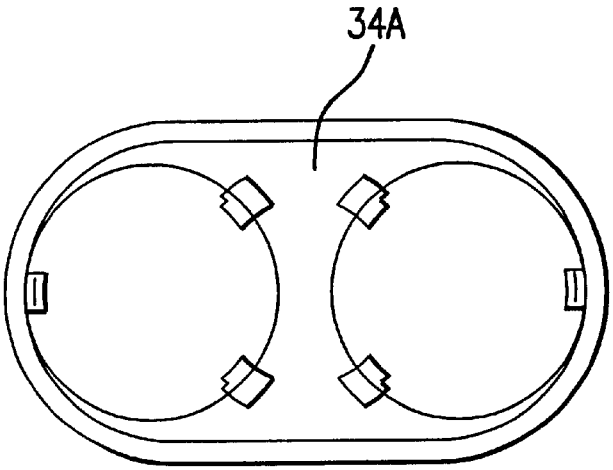
FIGS. 6C–6D shows a second preferred embodiment of the base of the toothpaste squeezing assembly.
Figure 6D:
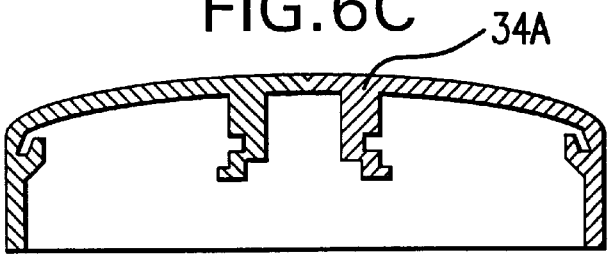
Figure 7A:
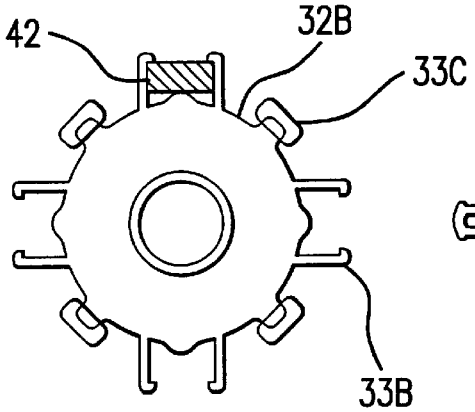
FIGS. 7A–7L illustrate another six preferred embodiments of the annular member of the toothpaste squeezing assembly.
Figure 7C:
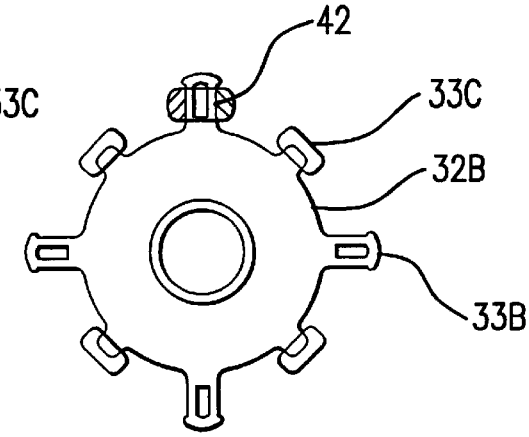
Figure 7B:
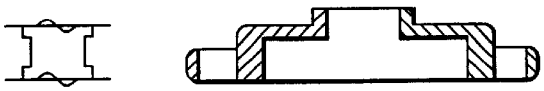
Figure 7D:
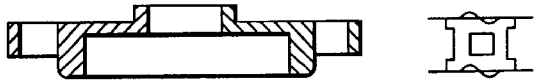
Figure 7E:
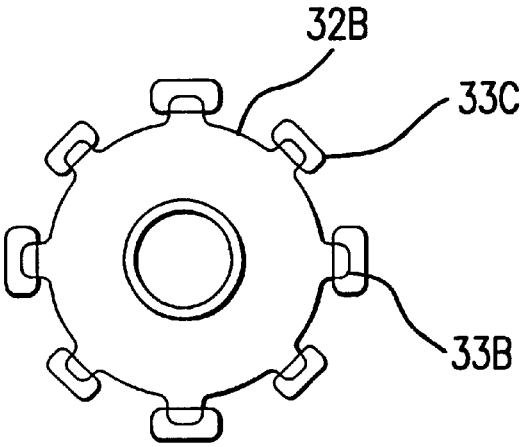
Figure 7G:
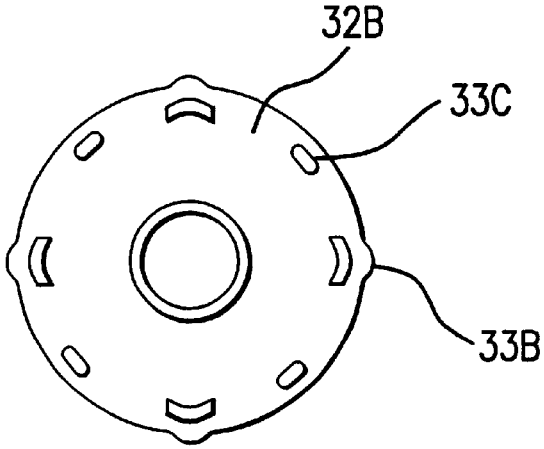
Figure 7F:
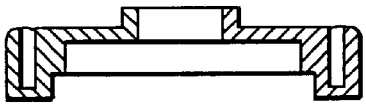
Figure 7H:
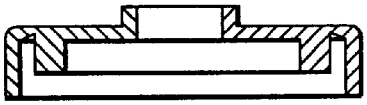
Figure 7I:
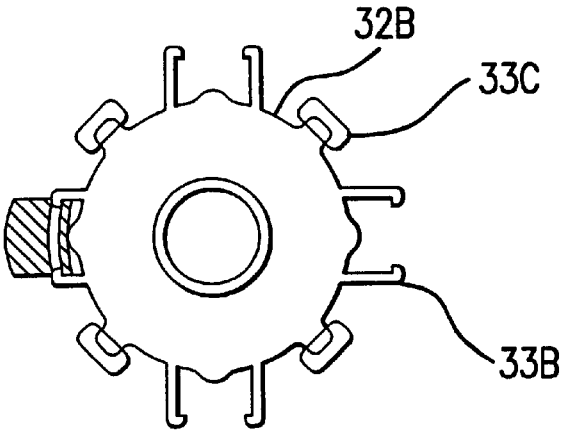
Figure 7K:
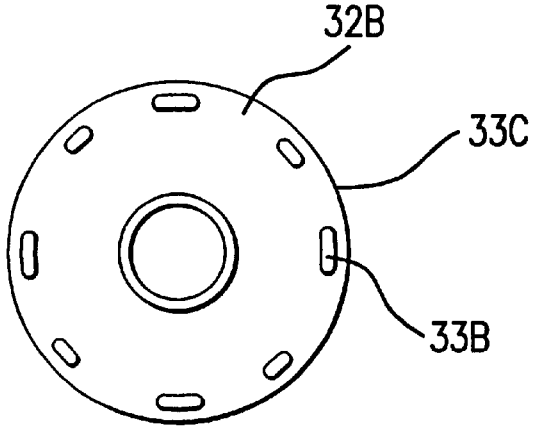
Figure 7J:
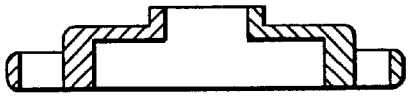
Figure 7L:
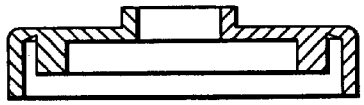

FIG. 5A is a sectional view showing the engagement of the cover 30 and the annular member 32. FIG. 5B is a sectional view illustrating the engagement of the base 34 and the movable cap 37. FIGS. 6A–D illustrate a second preferred embodiment of the present invention, wherein the annular member 32A, the cover 30A and the base 34A are formed with two holes, and the annular member 32A may be wavy in shape. In addition, the toothpaste squeezer may be directly engaged with the movable cap 37 at the bottom and with a single-hole annular member 32B at the top. Further, as shown in FIGS. 7A–L, the lugs 33B and 33C of the annular member 32B may be of different types so as to be adapted for use with different types of toothbrushes 40, 40M, and hooks 42, 42M. In other words, the present invention may be provided with one or more toothpaste squeezers to form a desired toothpaste squeezing assembly 10. The small lug 33C is a hook that can be used to hang a long-handled dental mirror (not shown).

Figure 8A:
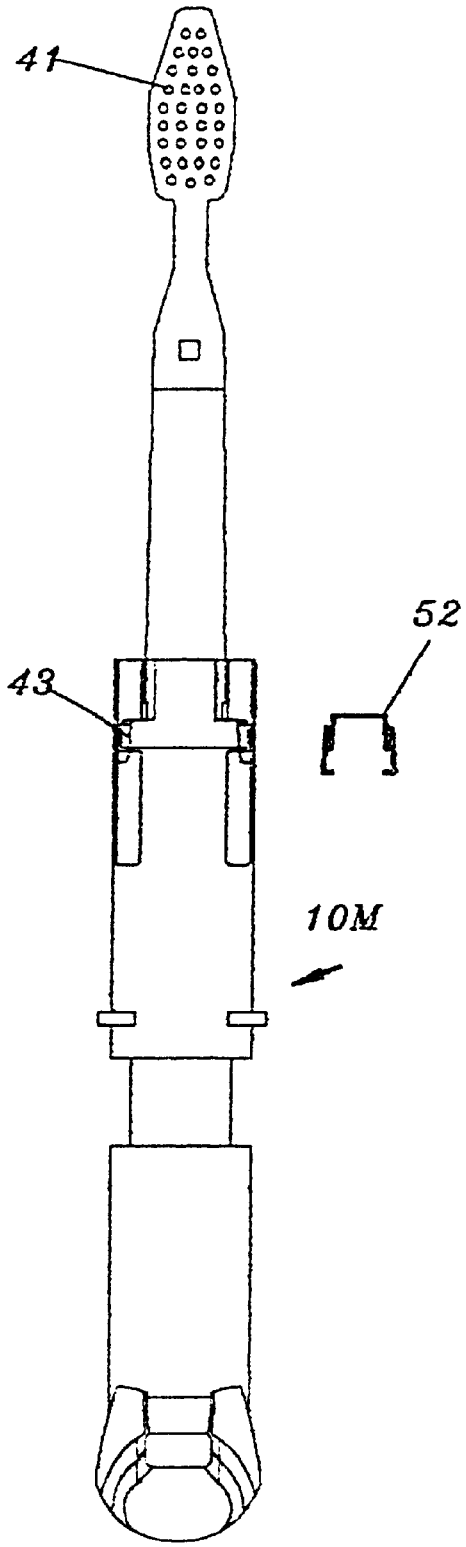
FIGS. 8A and 8B illustrate front and side views of a second preferred embodiment of the toothbrush and toothpaste squeezing assembly unfolded.
Figure 8B:
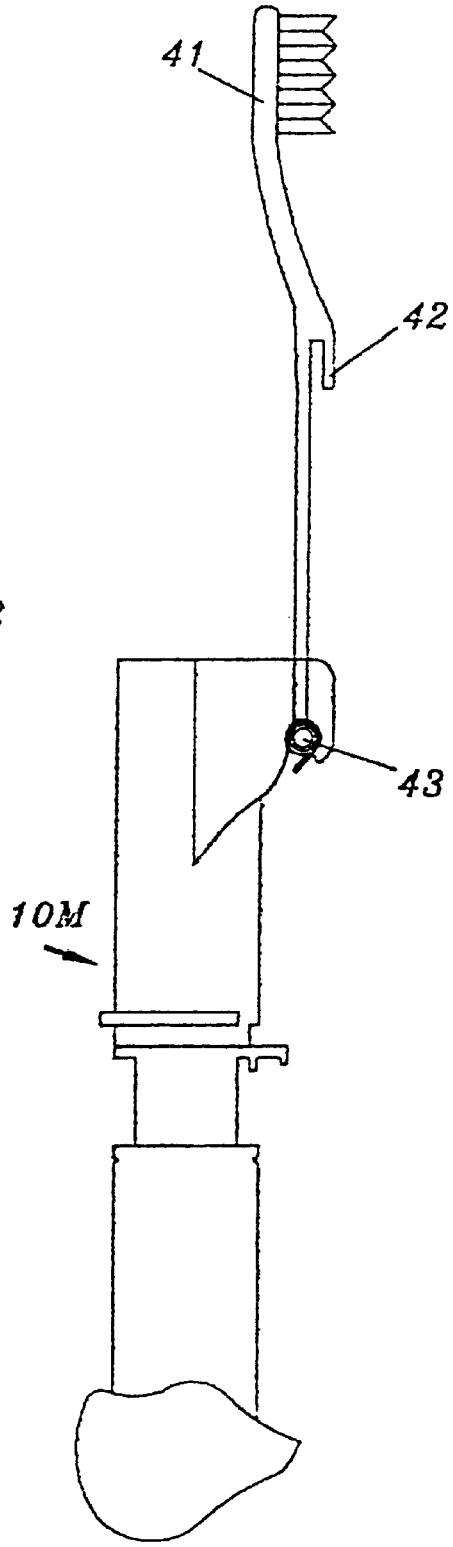
Figure 9A:
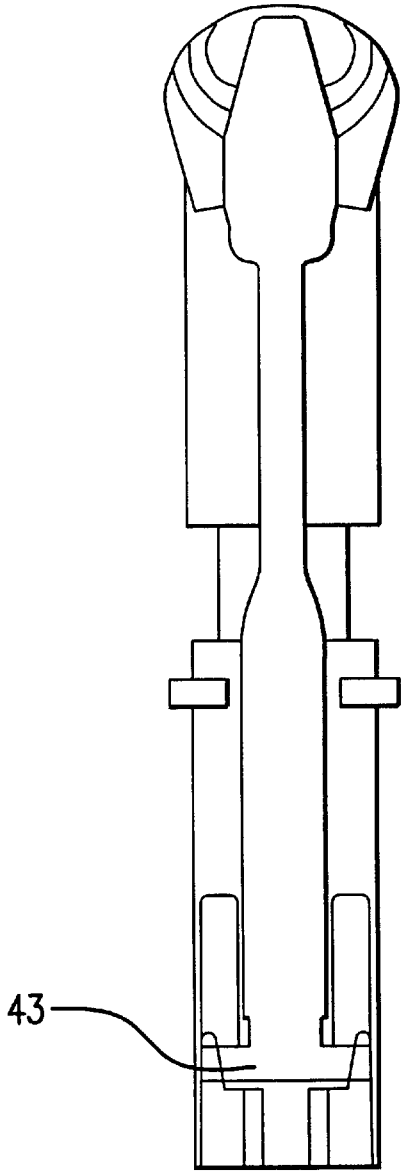
FIGS. 9A and 9B illustrate a front and side views of the second preferred embodiment of the toothbrush and toothpaste squeezing assembly folded.
Figure 9B:
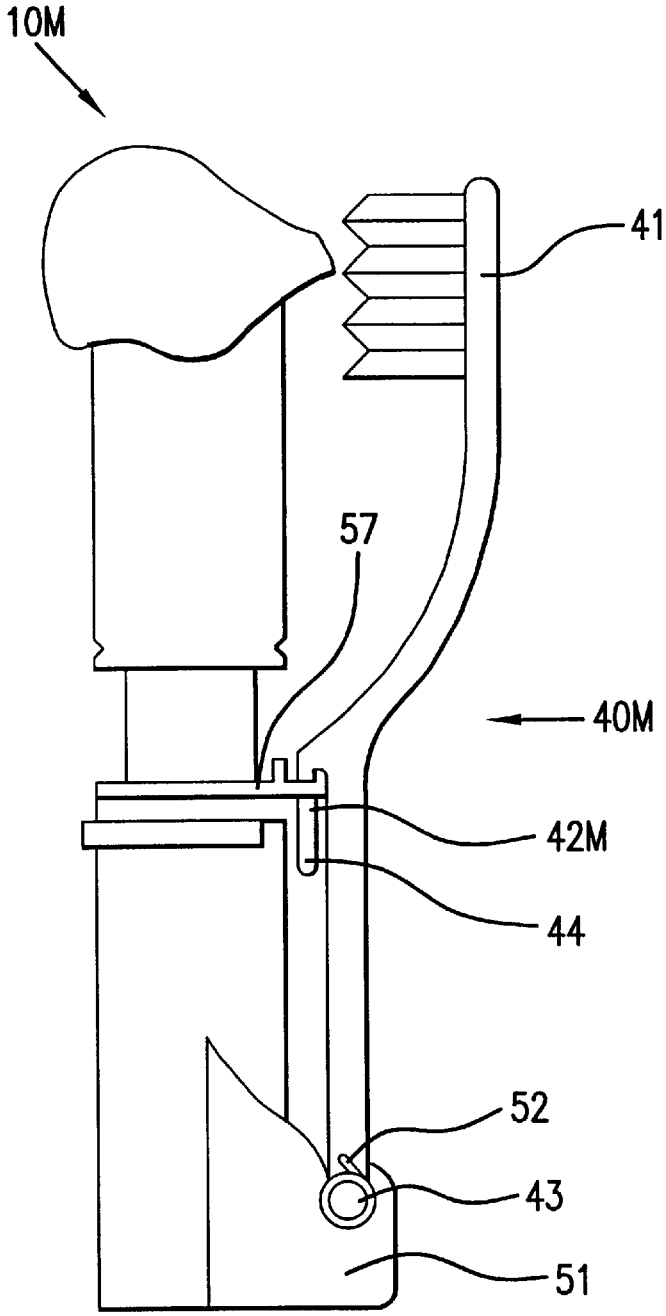
Figure 10:
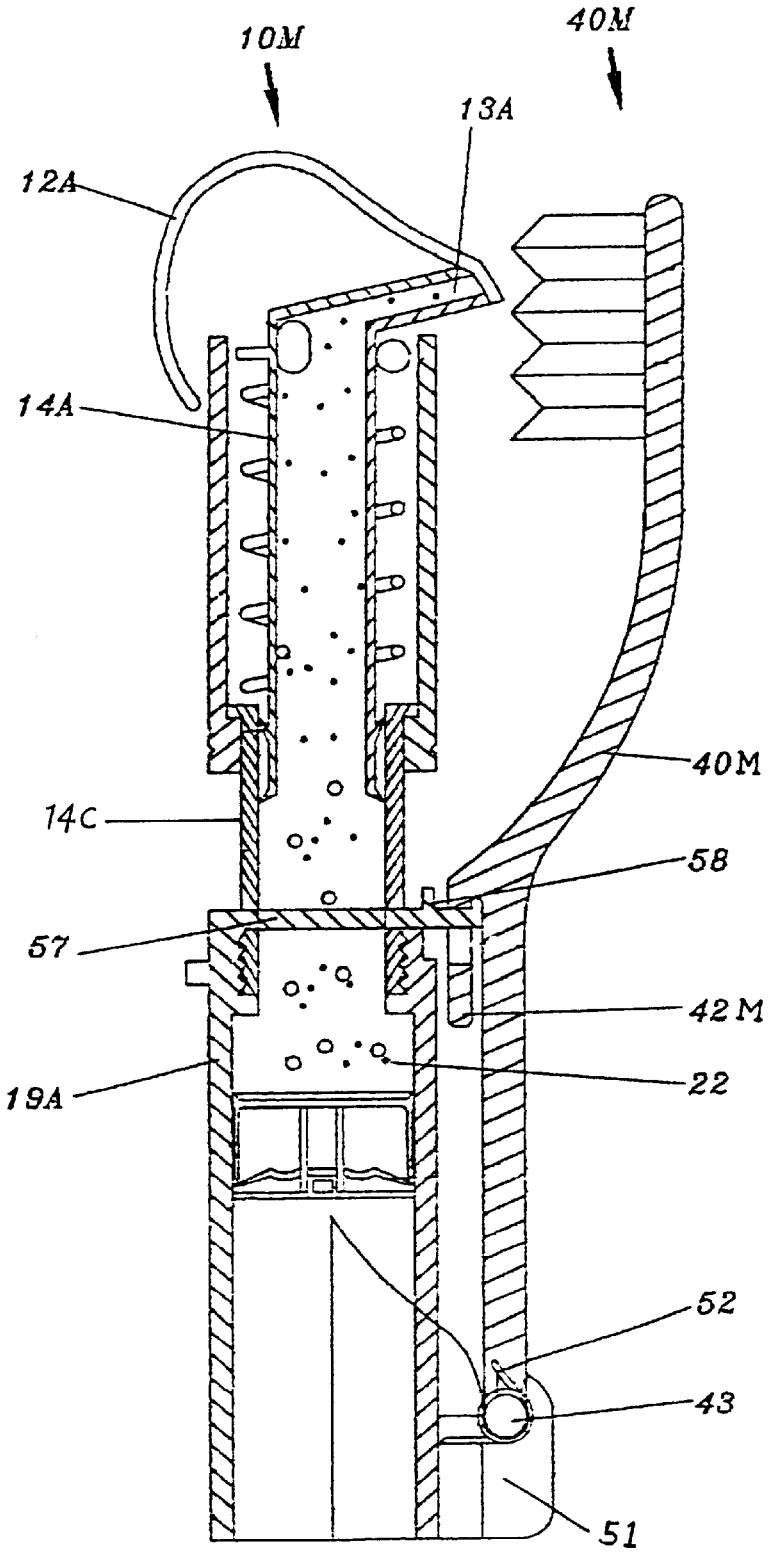
FIG. 10 illustrates another preferred embodiment of the toothbrush and toothpaste squeezing assembly.

FIGS. 8A and 8B illustrate the engagement of a toothbrush 40M with a small toothpaste squeezing assembly 10M. FIGS. 9A, 9B and 10 illustrate how the toothbrush 40M is folded in a small toothpaste squeezing assembly 10M. As shown, the small toothpaste squeezing assembly 10M includes a seat 51 and a spring 52. A short-handled toothbrush portion 41 is pivotally connected to the seat 51 by an axle 43. The toothbrush 40M is normally disposed in a straight position so that its hook 42M hangs on the annular member 32 of assembly 10. When a user wants to use the toothbrush 40M, the user removes toothbrush 40M from the assembly 10, and then rotates the toothpaste squeezing assembly 10M through an angle of 180 degrees toward the bristles of the toothbrush portion 41 so that the hook 42M slides through the hole 44 of the annular member 57.

Referring to FIG. 10, when in use, the cap 12A is depressed to squeeze the toothpaste 22 out of the tubular neck 14A of the toothpaste cylinder 19A. The paste 22 comes out of the outlet 13A, and the protuberance 58 of the annular member 57 is pressed to disengage the hook 42M from the annular member 57, thus causing the toothbrush 40M to move to a straight position for use. The toothbrush 40M may be folded after use, thereby making it convenient to carry. The toothbrush portion 41, the axle 43, and the seat 51 can be connected together by a connecting plate, and partially or wholly made by injection molding. The tubular neck 14C may be connected to the toothpaste cylinder 19A to make it disposable after use.

Referring to FIGS. 1, 6A, 6B, 7A–7L, 8A, 8B, 9A and 9B, each of the toothbrushes 40 and 40M is provided with a hook for hanging on the lug 33, 33A, 33B of the annular member 32, 32A, 32B and toothbrush 40M has an axle 43 for engaging with the seat 51 of the toothpaste squeezing assembly 10M. Each of the hooks 42 and 42M and the axle 43 are designed to make the bristles of the toothbrush align with the outlet 13, 13A. However, for electric toothbrushes, the hook may be provided on a detachable power handle. The toothbrush may be made of resilient foam plastic.

Figure 11:
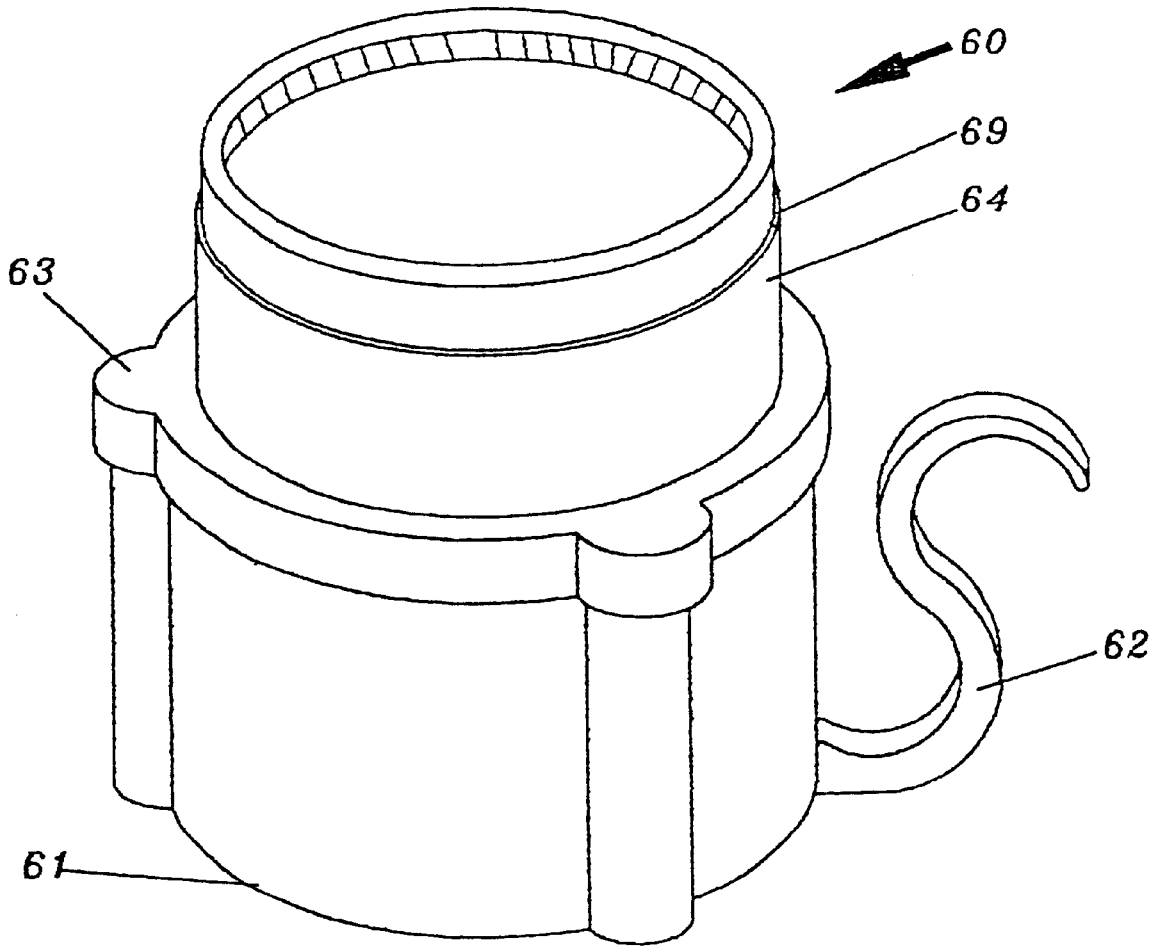
FIG. 11 is a perspective view of the spring mug.
Figure 12:
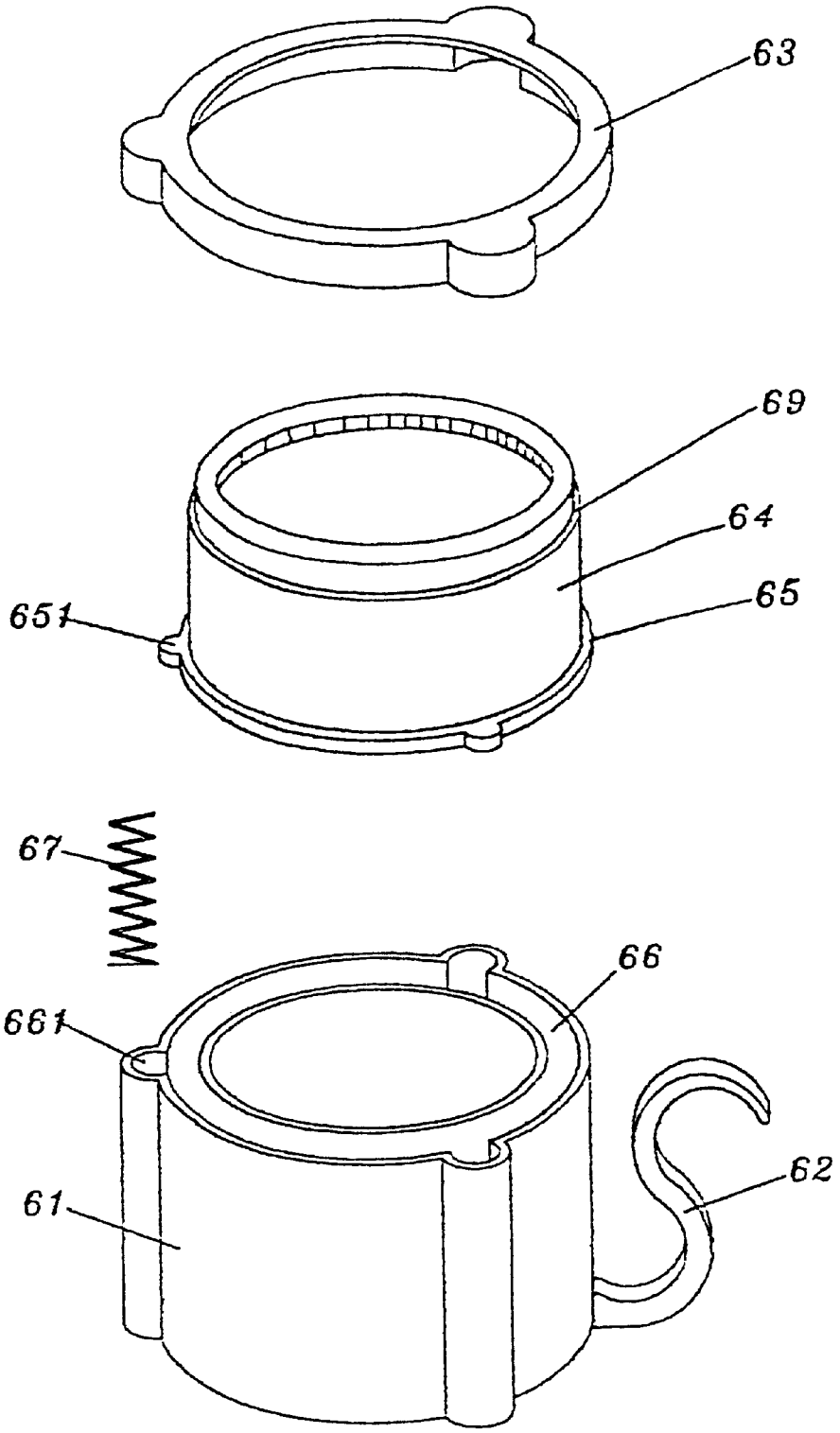
FIG. 12 is an exploded view of the spring mug.

FIGS. 11 and 12 are a perspective view and an exploded view of the spring mug 60, respectively, used as a container for liquid when brushing with toothbrush 40, 40M. As shown, the spring mug 60 is made of a body 61, a bottom member 64, a ring member 63, a spring 67 and a handle 62. The body 61 has an annular groove 66 formed with three cavities 661. One of the cavities 661 receives the spring 67. The bottom member 64 has a flange 65 formed with three projections 651. The bottom member 64 engages the body 61 with the projections 651 slidably fitted into the cavities 661. The ring member 63 is sleeved over the bottom member 64 to be fixedly mounted with the body 61, thereby retaining the bottom member 64 in the body 61. Normally, the spring 67 forces the bottom member 64 to position with the recessed portion 69 engaging the ring member 63 so that the spring mug 60 can be fitted into the lower portion of the rack 70. When the spring mug 60 is removed from the rack 70, the protuberances 73 at two sides of the rack 70 will adjust the position of the bottom member 64 with respect to the body 61 and ring member 63, thereby causing the spring 67 to force the bottom member 64 outward, thereby increasing the capacity of the spring mug 60. The annular groove 66 with three cavities 661 may be replaced with a larger circular groove adapted to receive a single spring.

Figure 13:
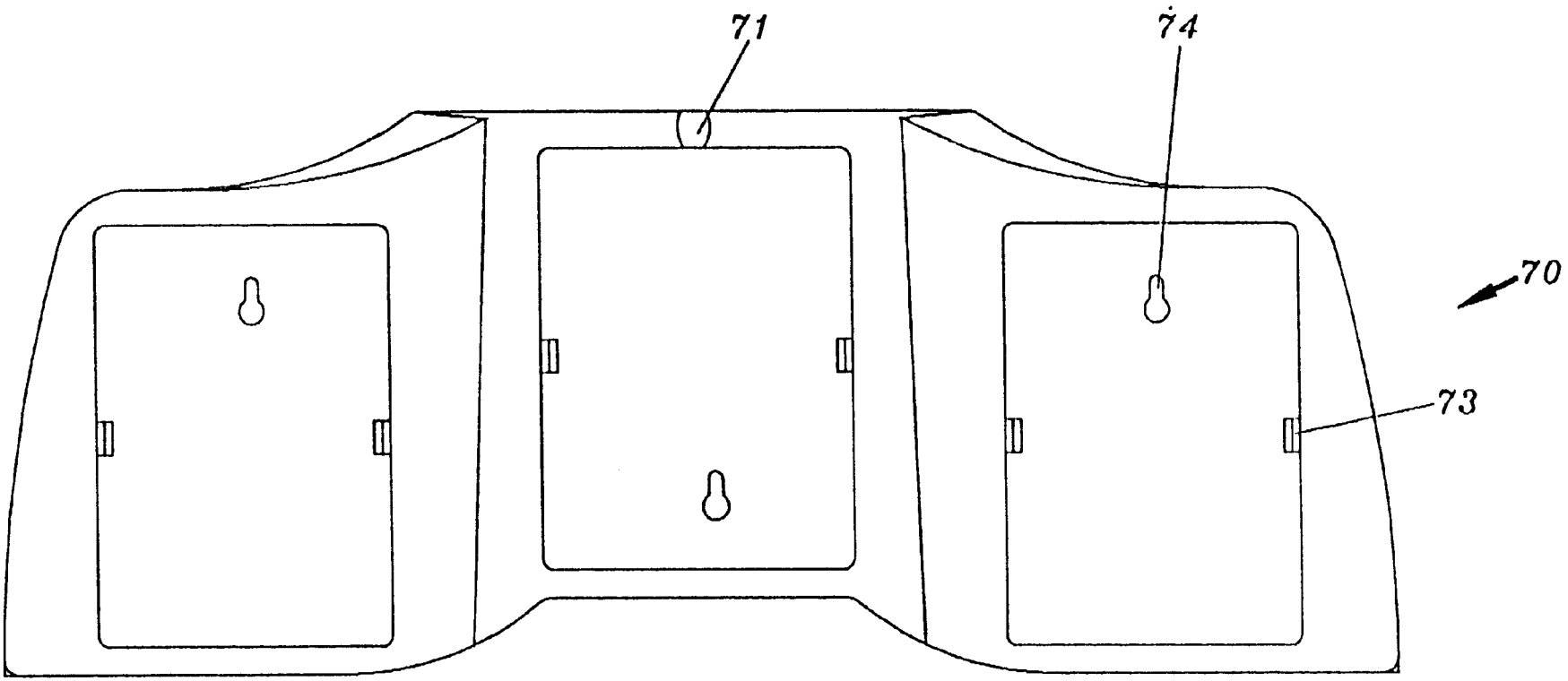
FIG. 13 is a view of the rack.

Referring to FIG. 13, the upper portion of the rack 70 is formed with a cavity 71 adapted to be engaged by a protrusion 39 at the lower end of the toothpaste squeezing assembly 10. The interior of the rack 70 is divided by two partitions into three chambers for receiving spring mugs 60. The rack 70 has two holes 74 for hanging the rack on the wall.

The above-mentioned component parts form the tooth cleaning assembly according to the present invention. The rack 70 receives the toothpaste squeezing assembly 10, on which are hung toothbrushes 40 and 40M. Spring mugs 60 or 60M are fitted within the rack 70.

While certain novel features of this invention have been shown and described and are pointed out in the annexed claims, it will be understood that various omissions, modifications, substitutions and changes in the forms and details fo the device illustrated and in its operation can be made by those skilled in the art without departing in any way from the spirit of the present invention. Accordingly, the above disclosure should be construed as limited only by the restrictions of the appended claims.

I claim:

1. A tooth cleaning assembly comprising:

a rack;

at least one detachable toothpaste squeezing assembly mounted on said rack, said toothpaste squeezing assembly comprises a base, at least one toothpaste cylinder having a lower end fitted in said base, an annular member arranged adjacent an upper end of said toothpaste cylinder, a cover fitted on a top of said toothpaste cylinder and mounted on said annular member, a pair of telescopically coupled inner tubular necks in fluid communication with said toothpaste cylinder, a cap displaceably connected with an upper end of an uppermost one of said inner tubular necks, and a movable cap detachably engaged with a bottom of said base;

at least one toothbrush detachably mounted on said annular member; and at least one spring mug contained in said rack.

2. The tooth cleaning assembly as claimed in claim 1, further comprising an outer upper tubular neck and an outer lower tubular neck sleeved over said inner tubular necks and telescopically coupled together, said uppermost inner tubular member being slidably disposed within said outer upper tubular neck, said cap of said toothpaste squeezing assembly having a first axle hole engaged with said outer upper tubular neck and a second axle hole engaged with said uppermost inner tubular neck, and wherein a spring is fitted between said outer upper tubular neck and said uppermost inner tubular neck.

3. The tooth cleaning assembly as claimed in claim 1, wherein: said toothbrush is pivotally and foldably connected with a toothpaste squeezer of said toothpaste squeezing assembly.

4. The tooth cleaning assembly as claimed in claim 1, wherein: said spring mug includes a body having an annular groove with three cavities, one of said cavities receives a spring, a bottom member having a flange, and a ring member sleeved over said bottom member to be fixedly mounted on said body.

* * * * *